US005845854A

United States Patent [19]

Adam et al.

[11] Patent Number: 5,845,854

[45] Date of Patent: Dec. 8, 1998

[54] METHOD OF SOLID INSULATOR DESTRUCTION

[75] Inventors: A. Adam; V. Vajov; G. Vorob'ev; B. Levchenko, all of Tomsk; B. Siomkin, Barnaul; A. Chepikov, Tomsk, all of Russian Federation

[73] Assignee: ITAC Ltd., Kamakura, Japan

[21] Appl. No.: 662,801

[22] Filed: Jun. 12, 1996

[30] Foreign Application Priority Data

Jun. 13, 1995 [RU] Russian Federation ..... 95109820/03

[51] Int. Cl.[6] ..... B02C 19/00; B02C 19/12

[52] U.S. Cl. ..... 241/1; 241/15; 241/30

[58] Field of Search ..... 241/1, 15, 30, 241/301, 23

[56] References Cited

U.S. PATENT DOCUMENTS

| | | | |
|---|---|---|---|
| 3,840,270 | 10/1974 | Allgood | 241/1 X |
| 4,313,573 | 2/1982 | Goldberger et al. | 241/1 |
| 4,540,127 | 9/1985 | Andres | 241/1 |
| 4,653,697 | 3/1987 | Codina | 241/1 |

FOREIGN PATENT DOCUMENTS

| | | | |
|---|---|---|---|
| 2004996 | 5/1983 | Germany | 241/1 |
| 555226 | 4/1977 | U.S.S.R. | 241/1 |
| 717331 | 2/1980 | U.S.S.R. | 241/1 |
| 1741900 | 6/1992 | U.S.S.R. | 241/1 |

OTHER PUBLICATIONS

Exploration Drilling by N.I. Kulichnin, B.I. Vozdvijensky, published in Nedra. 1973, p. 419.

Description of the invention to the author's certificate No. 71996 by A.A. Agroskin and E.A. Meerovitch, published Mar. 31, 1948.

*Primary Examiner*—John M. Husar
*Attorney, Agent, or Firm*—Jordan and Hamburg

[57] ABSTRACT

A method of solid insulator destruction comprising the steps of placing electrodes on a surface of a solid insulator, covering an area of the surface the solid insulator proximate the electrodes with liquid having greater electrical insulative properties against pulse voltage than the solid insulator; and applying a pulse voltage across said electrodes having a rise time to breakdown of the solid insulator of about t where $t=2\times10^{-6}\times S^{0.3}$ (sec) and S (cm) is the distance between the electrodes. The solid insulator material includes at least one of rock, permafrost, ice and artificial solids including concrete, ceramics, and plastics.

12 Claims, 5 Drawing Sheets

METHOD OF SOLID INSULATOR DESTRUCTION

BACKGROUND OF THE INVENTION

The present invention relates to a method of solid insulator destruction which destroys solid insulators by electric pulse discharges. The solid insulators include rock, permafrost, ice, and artificial solids, for example concrete, ceramics, and plastics.

Mineral resources are typically considered solid insulators for purposes of the present invention. A prior method of solid insulator destruction applied to mineral resources using an electric current is known in the prior arts. One known method of mineral resources destruction including a process of applying high-voltage electric pulses to a plurality of electrodes in contact with rock is disclosed in the author's certificate No 71996, class 5c, 7 M II K E21C 37/18 published, Mar. 31, 1948. However, the method has a disadvantage in that an efficiency of destruction is small.

Another method of mineral resources destruction is proposed which includes a process of applying electric pulses to electrodes in contact with rock so as to cause electric discharges and a process of destroying the rock with the electric discharges. N. L. Kulichnin B. L. Bozdvijensky. Exploration drilling. Nedra. 1973, p. 419. According to this method, a hole is first bored in the ground until rock is found. Next, two electrodes are placed on a bottom of the hole in contact with the rock. The hole then is filled with a liquid such as transformer oil, diesel fuel or others having electrical insulative characteristics higher than the rock, following which electric voltage pulses are established between the electrodes to produce electric discharge resulting from the electric voltage pulses which penetrates through the rock and causes destruction of the rock formation. This method teaches that the pulse duration must be equal or shorter than $1\times10^{-6}$ (sec). However, the method has a disadvantage in that a work efficiency of destruction is small because the method does not make it possible to predict the probability of destruction applying the steps of the method.

According other reports concerning the prior method of rock destruction using high-voltage pulse discharges, an efficiency of rock destruction increases linearly with increasing a distance between the electrodes. However, the time of voltage increasing till the rock breaking-down becomes more than $1\times10^{-6}$ (sec) which is contrary to the aforesaid teachings. Furthermore, it is has been known that a probability of electric discharge penetrating through the rock decreases with increasing the distance between the electrodes. Thus, the prior method of solid insulator destruction has a disadvantage in that selection of the most suitable mode for the destruction of solid insulators is not made possible.

SUMMARY OF THE INVENTION

Accordingly, a primary object of the present invention is to provide a method of solid insulator destruction wherein a time of pulse voltage increasing till the solid insulator breakdown is not too long and a probability of electric discharge penetrating through the solid insulator is not decreased with increasing the distance between electrodes. Accordingly, the second object of the present invention is to provide a method of solid insulator destruction which enables selection of the most suitable mode for facilitating destruction and enabling an increase in efficiency of the destruction.

Briefly stated, the present invention provides a method of solid insulator destruction which includes placing electrodes on a surface of a solid insulator, covering surfaces of the solid insulator, at least around the electrodes with a liquid having electrical insulative properties against pulse voltage higher than the solid insulator, and establishing voltage pulses between the electrodes so as to cause electric discharges. The electric discharges created by the electric voltage pulses penetrate through the solid insulator so as to destroy the solid structure of the solid insulator.

In an embodiment of the present invention, a time of voltage increasing till the solid insulator breakdown occurs (hereinafter voltage rise time) is selected according to formula 1 presented below.

FORMULA 1

$$t \leqq 2\times10^{-6}\times S^{0.3}(sec)$$

where S (cm) is a distance between the electrodes.

Diesel oil, water, seawater, grease can be applied to the above liquid.

The present invention is especially suitable where the solid insulator is rock, permafrost, ice or artificial solids such as concrete, ceramics or plastics etc. The present invention is also suitable for increasing a probability of the electric discharge penetrating through the solid insulator by means of covering the surfaces of the solid insulator with the liquid over an area which is as large as possible and the electrical insulative properties of the liquid against pulse voltage is higher than that of the solid insulator. Accordingly, it is preferable that the liquid be entirely covering the surfaces of the solid insulator.

Accordingly, covering a large area of the surfaces of rock with transformer oil which has an electric insulation characteristic that is high is preferable in order to increase the probability of the electric pulse discharge penetration through the solid insulator, such as rock. Where the insulation of the liquid against pulse voltage is higher than that of solid insulator, covering the surfaces of the solid insulator with liquid entirely is best in order to increase the probability of the electric discharge penetrating the solid insulator.

Thus, the present invention prevents the electric discharges between the electrodes from flowing outside of the solid insulator by covering the surfaces of the solid insulator, at least around said electrodes, with liquid providing greater electrical insulation against pulse voltage than the solid insulator. Along with use of the insulating liquid, the present invention provides for the most suitable mode for the destruction of the solid insulator by providing a voltage pulse having a rise time selected according to the formula 1. The formula 1 enables the distance between the electrodes to be increased so that the rise time is not too long and so that the probability of the electric discharge penetrating through the solid insulator is not decreased.

DETAILED DESCRIPTION OF THE INVENTION

Figure 1:
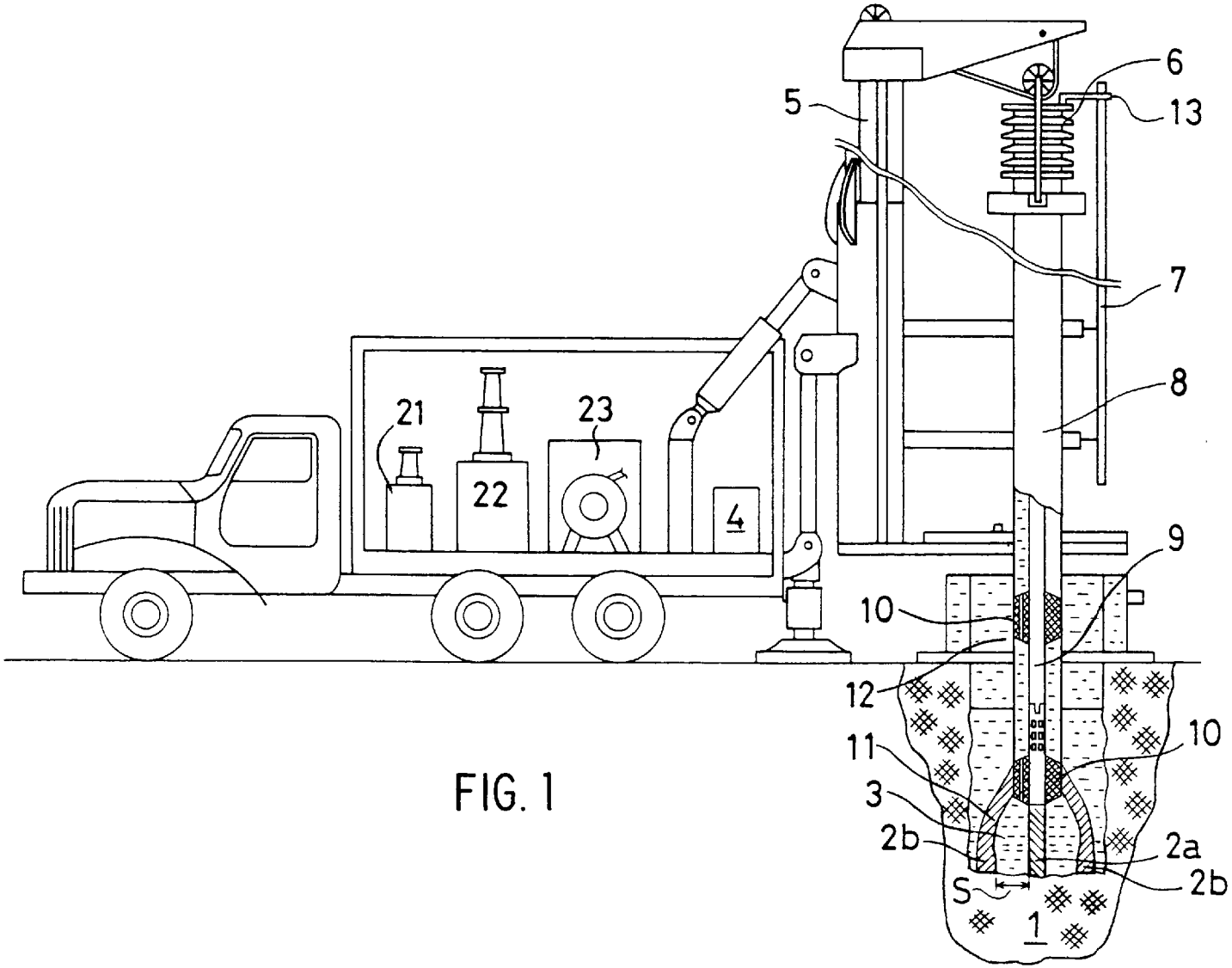
FIG. 1 shows an embodiment of an apparatus for practicing the present invention.

Referring to FIG. 1, and embodiment of an apparatus for practicing the present invention is shown. In FIG. 1, a numeral 1 denotes rock which is an example of a solid insulator to which the present invention may be applied, numerals 2*a*, 2*b* denote electrodes, a numeral 3 denotes transformer liquid which is an example of a liquid having electrical insulation property against pulse voltage that is higher than the solid insulator, a numeral 4 denotes a transformer, a numeral 5 denotes a mast, a numeral 6 denotes a high voltage input, a numeral 7 denotes a high voltage bus, a numeral 8 denotes a bore, a numeral 9 denotes a high voltage electrode, numerals 10 denotes bushing insulators, a numeral 11 denotes an electrode for ground earth which functions also as a drilling tip, a numeral 12 denotes a tank for slime, a numeral 13 denotes a sliding current collector, a numeral 21 denotes a high voltage transformer, a numeral 22 denotes a high voltage impulse generator, a numeral 23 denotes a tank for slime washer.

Figure 2:
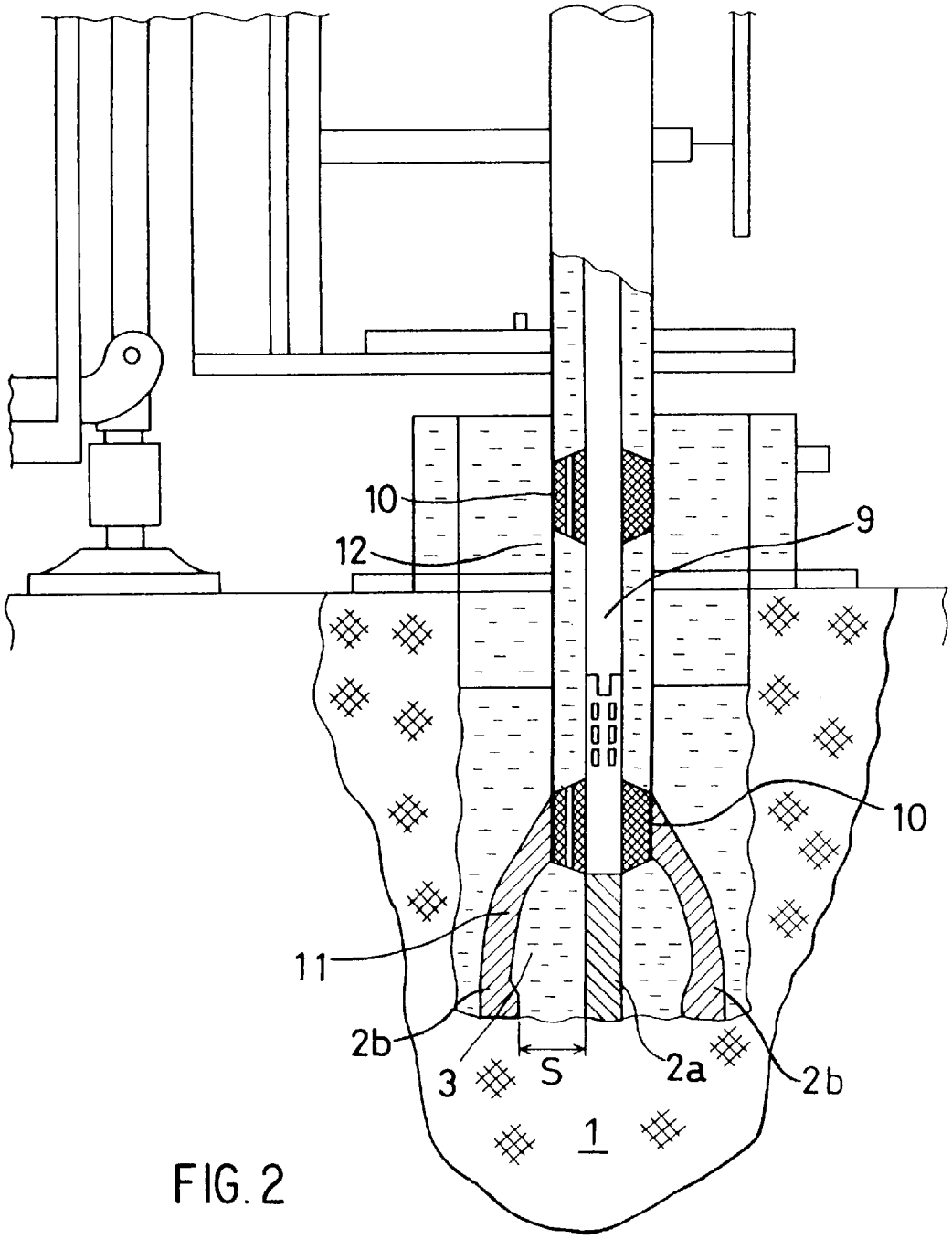
FIG. 2 shows an enlargement of a vicinity of electrodes shown in FIG. 1.

Referring to FIG. 2, a vicinity of the electrodes 2*a*, 2*b* of FIG. 1 is shown enlarged. The electrodes 2*a*, 2*b* are connected at a bottom end of the high voltage electrode 9 and the bore 8 and placed on a surface of the rock 1. The electrodes 2*a*, 2*b* are divided into the negative poles and the positive poles, that is, the discharging poles for discharging electric current and the receiving poles for receiving electric current. The number of electrodes 2*a*, 2*b* is properly decided depending on the application. However, at least two electrodes are necessary so as to provide the negative pole and the positive pole. In the illustrated embodiment, three electrodes are applied. The two electrodes 2*b* are grounded, and the distance S between the electrodes 2*b* and 2*a* is equal to or more than 1.0 cm.

The surfaces of the rock 1, at least around the electrodes 2*a*, 2*b* are covered with the transformer oil 3 providing greater electrical insulation than the rock 1. This insulation is what is observed when voltage pulses are established between the electrodes. Some types of liquid have different insulation properties for a constant voltage versus a pulse voltage. The present invention concerns the insulation properties with regard to pulse voltage.

The solid structure of the rock 1 is destroyed by producing high voltage electric pulses across the electrodes 2*a* and 2*b*. The pulse voltage across the electrodes 2*a* and 2*b* is preferably 200 KV.

A rise time t of the voltage pulse before breakdown of the solid insulator is selected according to formula 1 so that the rise time t is not too long. That is, an action time, or rise time, of the voltage pulse is properly chosen according to formula 1.

FORMULA 1

$$t \leqq 2\times10^{-6}\times S^{0.3}(sec)$$

where S (cm) is a distance between the electrodes.

Electric discharges occurring across the electrodes 2*a* and 2*b* are prevented from flowing outside of the rock 1 by covering the surfaces of the rock 1, at least around the electrodes 2*a* and 2*b*, with transformer oil 3 having a higher electrical insulation value against pulse voltage than that of the rock 1. Accordingly, in order to increase the probability of the electric discharge penetrating through the rock 1, the surfaces of the rock 1 should be covered with the transformer oil 3 over an area as large as possible. Accordingly, it is best for increasing the probability of discharge penetration that the transformer oil 3 be entirely covering the surfaces of the rock 1. However, it is also feasible that water, seawater, or grease may be applied instead of the transformer oil 3 depending upon an internal resistance of the high voltage impulse generator 22.

Test results of application of the above embodiment of the present invention are described below with reference to Tables 1 and 3. In one of the series of tests electric discharges penetrated in the rock 15 times. The rock destruction occurred 6 times of the 15 times penetration occurred. The probability of destruction was thus 40%. During the destruction, another effect was obtained in that pieces of the destroyed rock were removed by the transformer oil 3. The probability of the electric discharge penetrating through the rock increased with increasing the distance between the electrodes.

Figure 3:
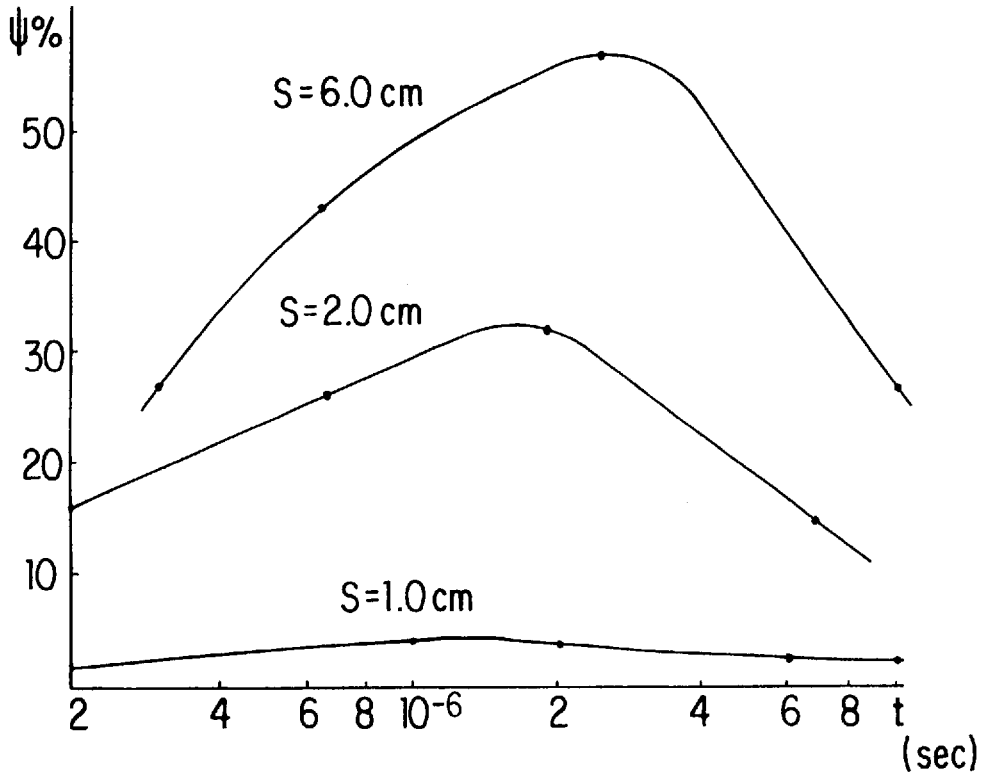
FIG. 3 shows a graph of a probability Ψ% of electric discharge penetration for various distances S between electrodes in association with voltage rise times.

It was experimentally confirmed that the probability of the solid insulator breaking-down increases with increasing the distance between electrodes. During the experiment, the solid insulator was kept in transformer oil. Results of the experiment is shown in FIG. 3 and Table 1 which show the change of the probability Ψ (%) of breaking-down caused from the electric discharge penetration through solid insulator for the various distances S (cm) between electrodes. FIG. 3 shows graphs concerning PTFE ( polytetrafluoroethylene) wherein the time t ($\times10^{-6}$ sec) of the voltage rise time until the solid insulator breaking-down is on a horizontal axis. The probability Ψ (%) of breaking-down increases with increasing the distance between the electrodes. The probability Ψ (%) of breaking-down increases from 4% to 56% (in other words increasing 14 times) and a maximum probability becomes clear when the distances S (cm) between the electrodes increases from 1.0 cm to 6.0 cm (in other words increasing 6 times). Thus, according to the present invention, the probability Ψ (%) of breaking-down does not decrease with increasing the distance between the electrodes.

Also, table 3 shows a result that the present invention is 1.24 times as likely to result in the solid insulation breaking-down as the prior art when the present invention is compared with one of the prior art based on the probability Ψ of breaking-down. In other words, the probability Ψ of breaking-down approximately increases by 30% from that of the prior art.

TABLE 1

| Material | Distance S | Ψ%/t | Ψ%/t | Ψ%/t | Ψ%/t | Ψ%/t | Ψ%/t |
|---|---|---|---|---|---|---|---|
| Felsite- | 1.0 | 20/0.2 | 37/0.6 | 40/1.0 | 41/2.0 | 6.5/6.0 | 5/10.0 |
| porphyry | 2.0 | 40/0.2 | | 86/1.0 | | | |
| Acrylic | 1.0 | 8.6/0.2 | 17.6/0.6 | 19.4/1.0 | 18.4/2.0 | 11/6.0 | 2/10 |
| plastic | 2.0 | | 42/0.6 | | | | |
| Polytetra- | 1.0 | 1.5/0.2 | 3.8/0.6 | 4/1.0 | 3.7/2.0 | 2.7/6.0 | 1.8/10 |
| fluoro- | 2.0 | 16/0.2 | 26/0.7 | 29/1.0 | 32/2.0 | 15/7.0 | |
| ethylene | 6.0 | 26/0.25 | 43/0.7 | | 56/2.5 | | 28/10 |

TABLE 2

| S cm | 1.0 | 2.0 | 3.0 | 4.0 | 10.0 | 20.0 | 30.0 | 70.0 | 80.0 |
|---|---|---|---|---|---|---|---|---|---|
| $t \times 10^{-6}$ (sec) | 2.0 | 2.5 | 3.0 | 3.2 | 3.7 | 4.7 | 5.0 | 7.6 | 7.9 |

TABLE 3

| | S (cm) | Ψ (%) | $t \times 10^{-6}$ (sec) |
|---|---|---|---|
| Prior | 6.0 | 45 | 1.0 |
| Present | 6.0 | 56 | 2.5 |

Figure 4:
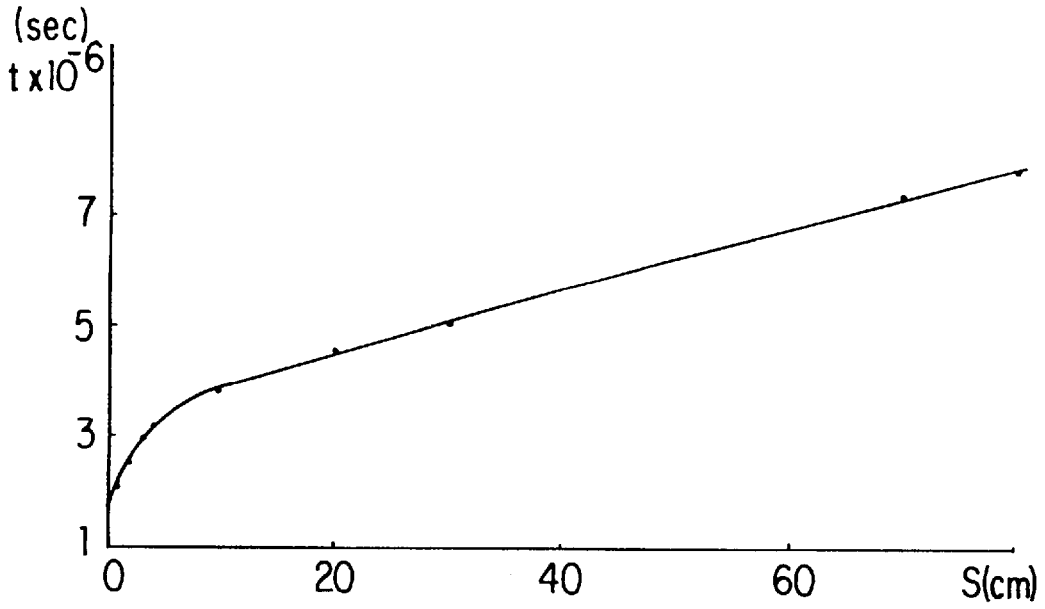
FIG. 4 shows a graph of voltage rise versus electrode separation distance S which provides a maximum probability Ψ% of solid insulator destruction.

FIG. 4 and Table 2 show observed time t of voltage rise time till breaking-down with the maximum probability Ψ (%) for various distances S (cm) between the electrodes wherein permafrost is the solid insulator. A graph of the observed time t in FIG. 4 approximately coincides with the above Formula 1 considering observation errors of ±20%. Accordingly, it is clear that the selection concerning the rise time t of the voltage until the solid insulator breaking-down according to Formula 1 (in other words, the proper choice concerning action time of voltage according to Formula 1) is useful.

Figure 5:
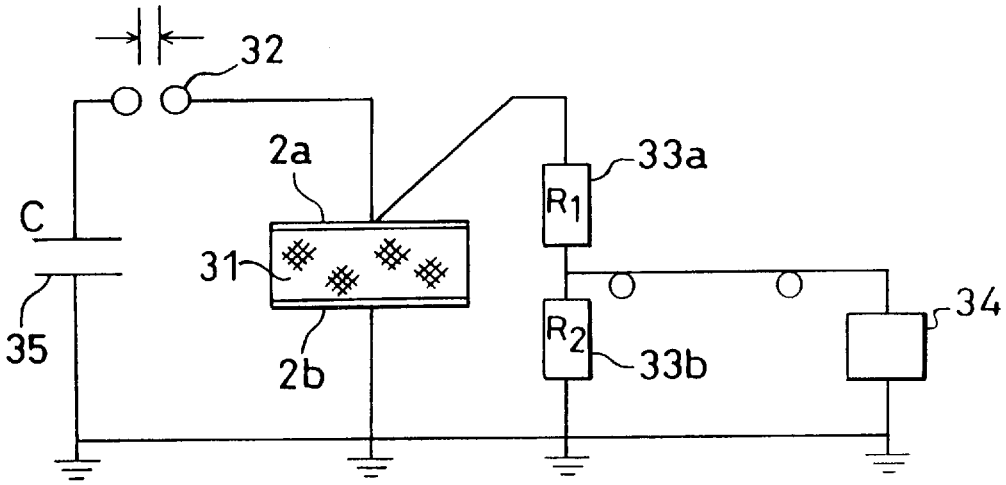
FIG. 5 shows a schematic of an embodiment of a circuit for detecting the voltage rise time.

Referring to FIG. 5, an embodiment of a circuit for detecting the rise time t of the voltage prior to breaking-down of the solid insulator is shown. The circuit has a solid insulator 31, a discharging switch 32, resistances 33*a* and 33*b* for adjusting detection of voltage, an oscilloscope 34, a condenser 35 which charges with electric current. The discharging switch 32 allows a discharging voltage and discharging time to be adjusted by changing a distance between electrodes of the discharging switch. Time is observed from a time point that a waveform of voltage starts from zero volts to a time point that the solid insulator breaks-down as the above rise time t of voltage prior to breaking-down.

Thus, the present invention prevents the electric discharges between the electrodes 2*a* and 2*b* from flowing outside of the solid insulator 1 by covering the surfaces of the solid insulator 1, at least around the electrodes 2*a* and 2*b*, with liquid having greater insulation properties against pulse voltage than the solid insulator 1, so that the probability Ψ (%) of the electric discharge penetrating through the solid insulator 1 increases. Along with the use of the insulating liquid 3, the present invention provides for selection of the most suitable mode for the destruction of the solid insulator by appropriate selection of the rise time of the voltage pulse prior to the solid insulator breaking-down according to Formula 1. Formula 1 enables the distance between the electrodes 2*a* and 2*b* to increase so that the rise time of the voltage is not too long and so that the probability of the electric discharge penetrating through the solid insulator does not decrease as described above. Accordingly, the present invention enables the selection of the most suitable mode for facilitating the destruction of the solid insulator and increasing an efficiency of the destruction.

We claim:

1. A method of solid insulator destruction comprising the steps of:

placing electrodes on a surface of a solid insulator;

covering an area of the surface the solid insulator proximate said electrodes with liquid having greater electrical insulative properties against pulse voltage than the solid insulator; and applying a pulse voltage across said electrodes having a rise time to breakdown of the solid insulator of about t where $$t=2\times10^{-6}\times S^{0.3}$$

and S is a distance between the electrodes in centimeters and t is in units of seconds so as to create an electric discharge through said solid insulator to fracture said solid insulator.

2. The method of solid insulator destruction according to claim 1, wherein said solid insulator is one of rock, permafrost, ice and artificial solids including concrete, ceramics, and plastics.

3. A method of solid insulator destruction comprising the steps of:

placing electrodes on a surface of a solid insulator;

covering an area of the surface the solid insulator proximate said electrodes with liquid having greater electrical insulative properties against pulse voltage than the solid insulator; and applying a pulse voltage across said electrodes having a rise time to breakdown of the solid insulator of about t where $$t=2\times10^{-6}\times S^{0.3}$$

in units of seconds and S is a distance between the electrodes in centimeters and is equal to or greater than 1.0 cm so as to create an electric discharge through said solid insulator to fracture said solid insulator.

4. The method of claim 3 wherein S is in the range of 1.0 to 6.0 cm.

5. The method of claim 3 wherein S is about 1.0 cm.

6. The method of claim 3 wherein S is about 2.0 cm.

7. The method of claim 3 wherein S is about 6.0 cm.

8. A method of boring a hole in a solid insulator comprising the steps of:

providing a bore tube with a drilling tip;

providing a high voltage electrode in said bore tube extending into said drilling tip and terminating in a first electrode disposed within said drilling tip so as to contact said solid insulator during boring using said drilling tip;

providing said drilling tip with a second electrode disposed to contact said solid insulator at a distance S from where said first electrode contacts said solid insulator during boring using said drilling tip;

applying said drilling tip to said solid insulator such that said first and second electrodes are in contact with said solid insulator;

filling a volume surrounding said drilling tip with a liquid insulator having greater electrical insulative properties against pulse voltage than said solid insulator such that said liquid insulator is in contact with a surface of said solid insulator proximate said drilling tip to prevent electric discharge between said first and second electrode outside of said solid insulator; and applying a pulse voltage across said first and second electrodes having a rise time to breakdown of the solid insulator of about t where $$t=2\times10^{-6}\times S^{0.3}$$

in units of seconds and S is a distance between the electrodes in centimeters and is equal to or greater than 1.0 cm so as to create an electric discharge through said solid insulator to fracture said solid insulator.

9. The method of claim 8 wherein S is in the range of 1.0 to 6.0 cm.

10. The method of claim 8 wherein S is about 1.0 cm.

11. The method of claim 8 wherein S is about 2.0 cm.

12. The method of claim 8 wherein S is about 6.0 cm.

* * * * *